United States Patent [19]

Deflander

[11] Patent Number: 4,562,936

[45] Date of Patent: Jan. 7, 1986

[54] EASY-OPEN LAMINATED CONTAINER WITH OPTIONAL RECLOSING MEANS AND METHOD OF MAKING

[75] Inventor: Joseph F. Deflander, Haacht, Belgium

[73] Assignee: The Procter & Gamble Company, Cincinnati, Ohio

[21] Appl. No.: 700,781

[22] Filed: Feb. 12, 1985

[51] Int. Cl.[4] ..... B65D 17/32

[52] U.S. Cl. ..... 220/268; 220/260; 220/278; 220/257; 220/258; 229/7 R

[58] Field of Search ..... 220/268, 260, 269, 270, 220/359, 265, 256–258; 229/43, 7 R; 222/541, 83; 156/243, 244.18, 250, 252, 253

[56] References Cited

U.S. PATENT DOCUMENTS

| | | | |
|---|---|---|---|
| Re. 21,310 | 12/1939 | Mackey | 221/11 |
| 2,098,763 | 11/1937 | Sebell | 221/11 |
| 2,870,935 | 1/1959 | Houghtelling . | |
| 2,974,824 | 3/1961 | Mansho . | |
| 3,029,009 | 4/1962 | Hill | 229/17 |
| 3,302,818 | 2/1967 | Balocca et al. . | |
| 3,338,462 | 8/1967 | Reynolds et al. . | |
| 3,339,788 | 9/1967 | Lipske . | |
| 3,355,059 | 11/1967 | Balocca et al. . | |
| 3,389,827 | 6/1968 | Abere et al. . | |
| 3,424,338 | 1/1969 | Kazel . | |
| 3,441,167 | 4/1969 | Balocca . | |
| 3,871,552 | 3/1975 | Irland et al. | 222/83 |
| 3,887,105 | 6/1975 | Chiappe | 220/277 |
| 3,913,782 | 10/1975 | Cass | 220/260 |
| 3,938,693 | 2/1976 | Patel et al. | 220/267 |
| 3,970,211 | 7/1976 | LaCross | 220/267 |
| 3,977,591 | 8/1976 | Martensson et al. | 229/7 R |
| 3,990,603 | 11/1976 | Brochman | 220/260 |
| 4,029,033 | 6/1977 | Kerwin et al. | 113/121 |
| 4,108,330 | 8/1978 | Patterson | 220/260 |
| 4,116,359 | 9/1978 | Josephy | 220/265 |
| 4,164,303 | 8/1979 | Waterbury | 220/359 |
| 4,170,314 | 10/1979 | Weierman et al. | 220/260 |
| 4,189,060 | 2/1980 | Trotman, III | 220/260 |
| 4,232,797 | 11/1980 | Waterbury | 220/359 |
| 4,378,074 | 3/1983 | Brochman | 220/260 |
| 4,407,424 | 10/1983 | Heyn | 220/269 |
| 4,428,494 | 1/1984 | Hirota et al. | 220/270 |
| 4,461,605 | 7/1984 | Stanek et al. | 220/260 |
| 4,462,732 | 7/1984 | Bloeck | 413/8 |
| 4,463,866 | 8/1984 | Mandel | 220/269 |
| 4,491,224 | 1/1985 | Horvath | 206/484 |
| 4,501,375 | 2/1985 | Katsura et al. | 220/270 |
| 4,513,876 | 4/1985 | Buchner | 220/270 |

FOREIGN PATENT DOCUMENTS

| | | |
|---|---|---|
| 2407345 | 5/1974 | Fed. Rep. of Germany . |
| 2528167 | 1/1976 | Fed. Rep. of Germany . |

*Primary Examiner*—George T. Hall

*Attorney, Agent, or Firm*—John J. Ryberg; John V. Gorman; Richard C. Witte

[57] ABSTRACT

An easy-open container having top and bottom end panels and a body portion, all of laminate construction comprised of an outer layer of stiff material, an intermediate layer of substantially gas-impermeable material, and a continuously sealed thermoplastic inner layer. The container's top end panel has a line of weakness in its outer stiff layer defining a tear-out section with opening means such as a tape tab non-critically bonded thereto. In a particularly preferred embodiment, the container is opened by pulling the opening means such that the tear-out section separates from the outer stiff layer along with the substantially coinciding portions of the intermediate layer and the inner layer that are attached thereto, thereby defining a dispensing aperture in the container's top end panel. In a particularly preferred embodiment, the container is provided with easy-open/reclosing means such as a rigid, plug-type member that is used to open and reclose the container. A high-speed manufacturing method for making the present invention is also disclosed.

37 Claims, 19 Drawing Figures

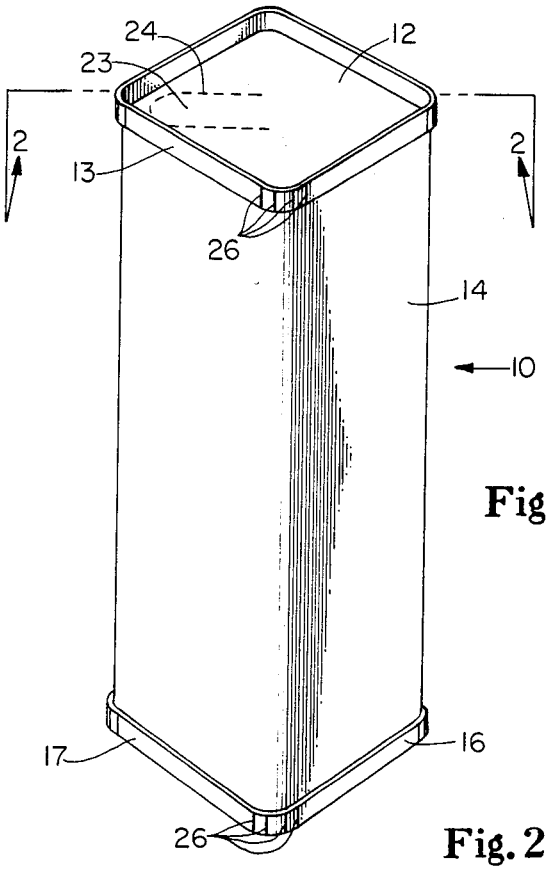
Fig. 1
Fig. 2
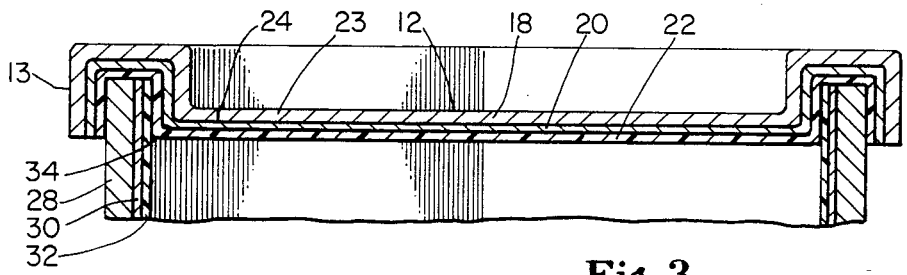
Fig. 3
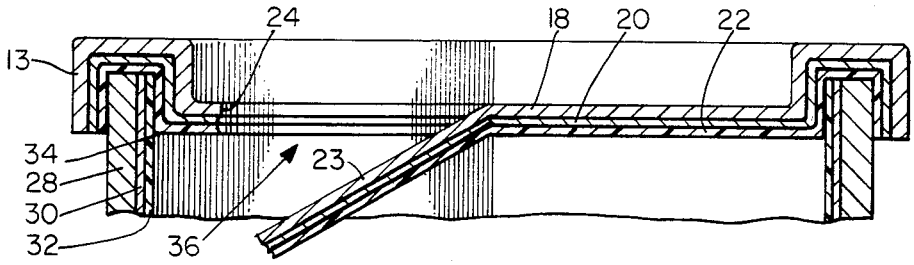

Fig. 10
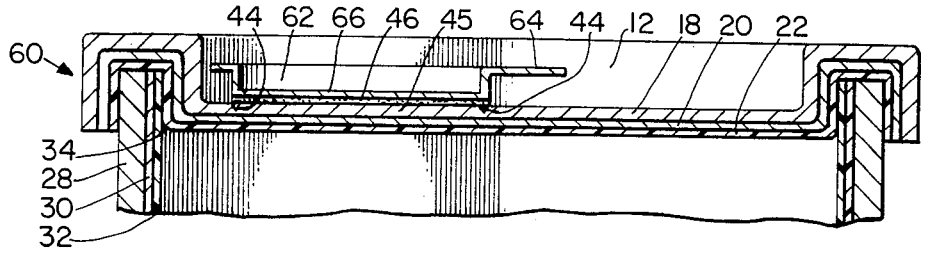
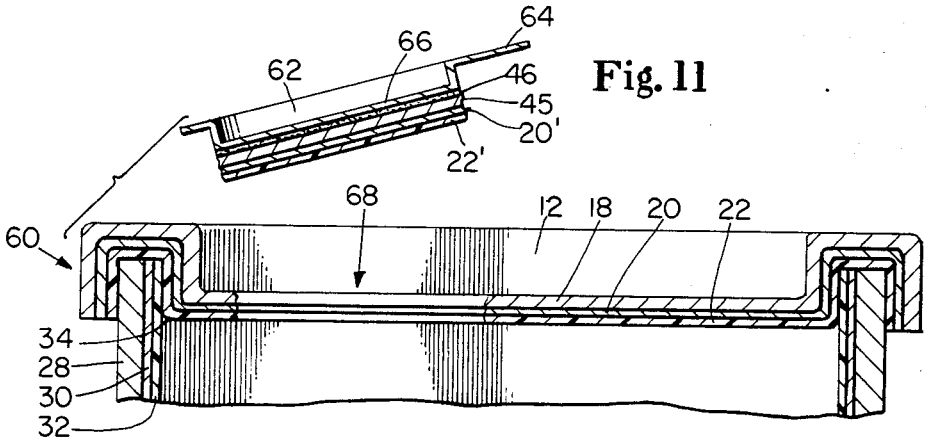
Fig. 11
Fig. 12
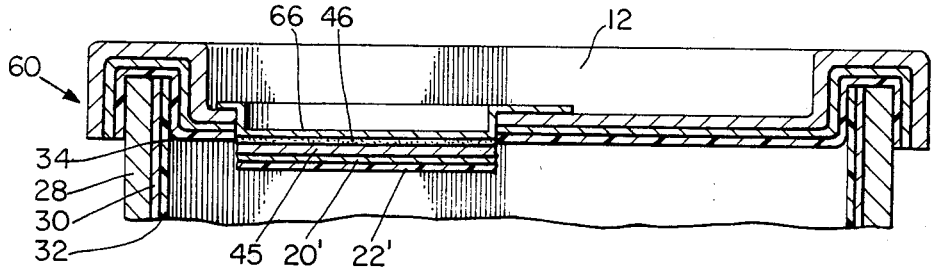

Fig. 13
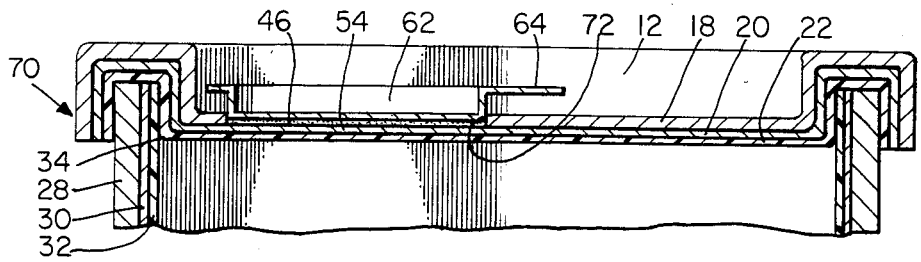
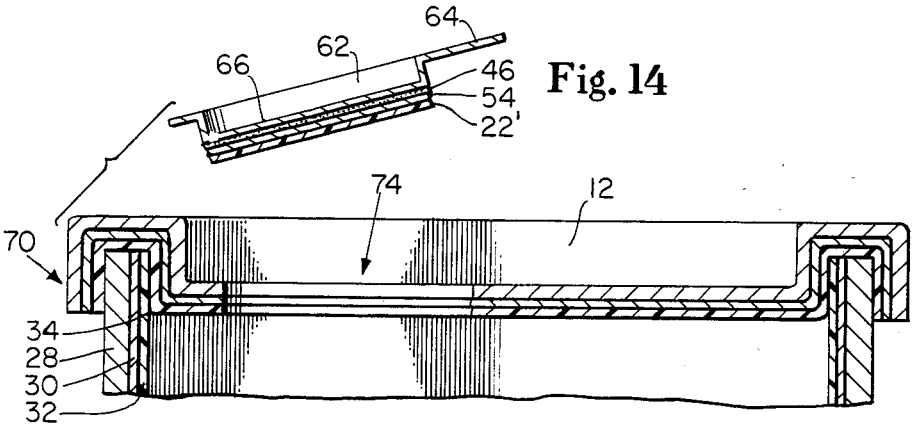
Fig. 14
Fig. 15
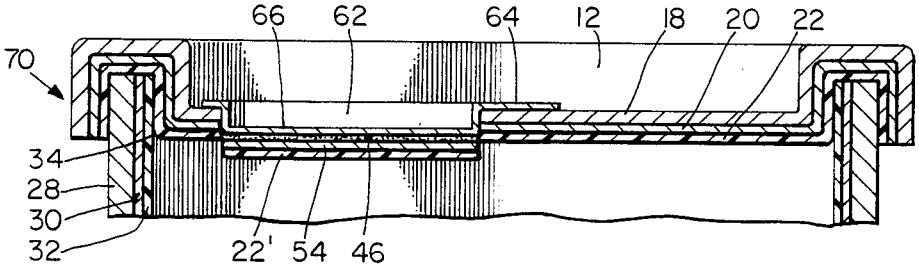

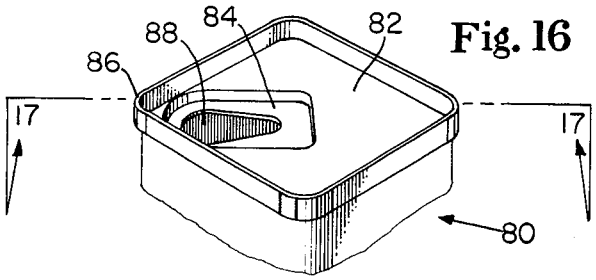
Fig. 16
Fig. 17
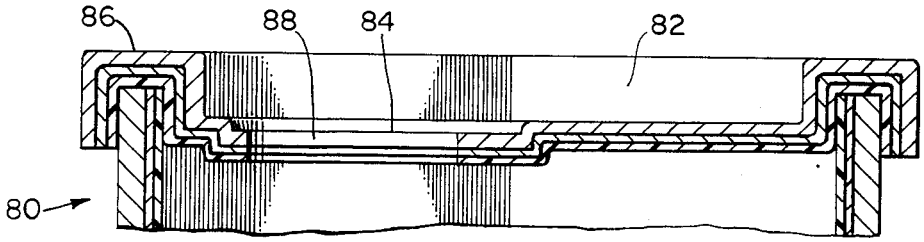
Fig. 18
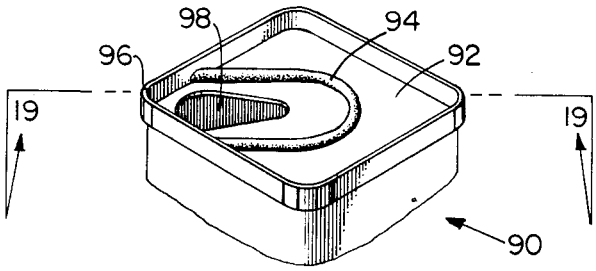
Fig. 19
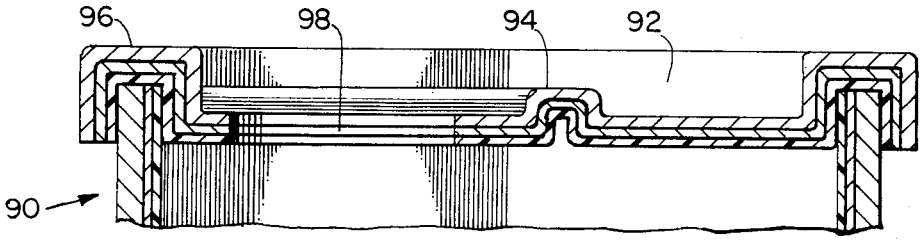

EASY-OPEN LAMINATED CONTAINER WITH OPTIONAL RECLOSING MEANS AND METHOD OF MAKING

TECHNICAL FIELD

The present invention relates to laminated containers, and more particularly to an easy-open or an easy-open/-reclosable laminated container having a substantially rigid outer layer with either a pre-cut or perforated dispensing aperture therein, a substantially gas-impermeable intermediate layer, and a continuously-sealed thermoplastic inner layer.

BACKGROUND OF THE INVENTION

Easy-open containers are used today to package virtually thousands of products, most notably beverages. An example of a particularly popular easy-opening system, which is commonly referred to as a "tape tab", utilizes a heat sealable strip of tape to seal a pre-cut dispensing aperture in the container's top end panel or lid. Early embodiments of this general concept are disclosed in U.S. Pat. No. 2,870,935 issued to Houghtelling, U.S. Pat. No. 3,186,581 issued to Schneider et al., and U.S. Pat. No. 3,251,515 issued to Henchert et al.

Easy-open containers employing the above-described tape tab have thus far met only limited success in the marketplace. A major problem associated with such a system is providing a gas and liquid impermeable seal between the tape and the outer surface of the container's lid. Another serious problem associated with such a system is the exposure of the aperture's raw edges to the product inside the container. One proposed solution to these problems is to cover the dispensing aperture with another discrete tape from the inner surface of the container's lid. An example of this "two-tape" system is disclosed in U.S. Pat. No. 3,339,788 issued to Lipske. While this two-tape system does appear to insulate the aperture's raw edges from the product, the gas and liquid impermeable seal problem is still present, i.e., this critical seal between the tape and the lid is merely moved from the lid's outer surface to the lid's inner surface. Furthermore, the cost of using two discrete tapes is undoubtedly much more expensive than using one. Other examples of this two-tape system are found in U.S. Pat. No. 3,355,059 issued to Balocca et al. and U.S. Pat. No. 3,990,603 issued to Brochman.

Returning to the single tape system, an improved means to obtain the critical seal between the tape and the container's lid has been suggested in U.S. Pat. No. 4,116,359 issued to Josephy. According to Josephy, a localized portion of a laminated tape having a bottom plastic layer is first extruded through the lid's aperture. Then, the plastic layer is radially outwardly squeezed around the aperture on the inner surface of the end panel, thereby providing the necessary critical seal. However, in a high-speed manufacturing setting, such a process would be incredibly expensive and slow. In addition, a laminated tape of the type found in Josephy is much more expensive to make than a single layer tape.

Another similar proposal to overcome the difficulties associated with utilizing a single tape tab to seal a dispensing aperture is disclosed in U.S. Pat. No. 3,338,462 issued to Reynolds et al. The proposal essentially consists of applying a laminated tape tab having a top layer of aluminum and a bottom layer of plastic in overlying relation to the pre-cut aperture, followed by applying heat and an anvil from the bottom surface of the lid to form what is call a "molded-in-situ" plug. When molded, this plastic plug seals the dispensing aperture and also acts as a protective coating around the aperture's exposed metal edges. Although Reynolds' system appears to be capable of sealing the aperture, it is also too complicated and difficult to practice on a high-speed manufacturing level because of the precise registration required between aperture, tape, plastic plug, and anvil. In addition, the laminate tape as described is also relatively expensive to make.

Another shortcoming of virtually all of today's easy-open containers is the inability to reclose the container after the initial opening thereof to preserve the container's contents and also to prevent foreign matter from entering the container during storage. In addition, if the container's contents includes suspended solids such as fruit pulp, most easy-open containers cannot be reclosed and shaken to redistribute such solids. An example of an easy-open container that does provide reclosing means is found in U.S. Pat. Nos. 4,164,303 and 4,232,797, both issued to Waterbury. These patents disclose several embodiments of an articulated closure element that is hingedly mounted on the container's lid adjacent to a pre-cut dispensing aperture. The closure element has a depending plug or bead on its undersurface that is shaped complementary to the aperture. After the closure element is lifted to initially open the container, the container may be reclosed by returning the closure element back to its original position such that the depending plug or bead engages the dispensing aperture.

Although Waterbury's articulated closure element system does allow an easy-open container to be reclosed after initial opening, the system requires a critical seal between the closure element and the container's lid very similar to that associated with tape tab systems as described earlier. Waterbury suggests that this critical seal can be achieved by thermoformation, i.e. applying heat to the lower edge of the thermoplastic closure element to cause the material to flow outwardly underneath the lid surface. Alternatively, Waterbury suggests that the depending plug or bead may be eliminated altogether and a plastic coating applied across the aperture from the lid's inner surface. However, eliminating the plug or bead and using this "inner patch" seal would presumably destroy the ability to reclose the container. In any event, a fair reading of Waterbury suggests that obtaining a critical seal between the closure element and the dispensing aperture is difficult to achieve, particularly if an aseptic seal is initially required.

Another problem associated with easy-open containers, particularly those having an upstanding rim about the periphery of the container's top lid, is that a residual amount of product is inevitably trapped between the dispensing aperture and the container's upstanding rim when the container is tipped to dispense the container's contents. When the container is returned to its upright position, this residual tends to spread out over the lid's surface and, during storage, begins to collect dirt and dust. Furthermore if the beverage is sweet such as a fruit juice, the residual attracts insects.

Another problem found in most easy-open containers is the failure to use suitable materials that simultaneously provide strength, oxygen impermeability, and protection against flavor loss of the container's contents.

In light of the above, it is a principal object of the present invention to construct a laminated easy-open container from materials that provide strength, oxygen impermeability, and protection against flavor loss.

Another principal object of the present invention is to eliminate the need for a gas and liquid impermeable seal between an easy-open container's opening means and the container's dispensing aperture.

It is another principal object of the present invention to provide an easy-open container with a relatively inexpensive easy-opening means that does not have to be made from materials having special properties such as gas impermeability or beverage-contacting compatibility.

Another principal object of the present invention is to provide an easy-open container with reclosing means.

It is another principal object of the present invention to eliminate the need for a gas and liquid impermeable seal between a container's easy-open/reclosing means and the container's dispensing aperture.

It is another principal object of the present invention to provide an easy-open container with a relatively inexpensive reclosing means that does not have to be made from materials having special properties such as gas impermeability.

It is another principal object of the present invention is to provide an easy-open container with a lid configuration that substantially reduces the tendency of the container's contents to spread out over the lid's entire outer surface after a portion of the container's contents have been dispensed.

Another object of the present invention is to provide a low cost, high speed method of making an easy-open or an easy-open/reclosable laminated container.

SUMMARY OF THE INVENTION

As used in the following summary and detailed description of the present invention, the term "critical seal" or variations thereof is intended to mean a gas and liquid impermeable, hermetic seal. When the term "reseal" or "reclose" is used in describing the container after the initial opening thereof, it is intended to mean only a liquid leak-resistant seal. In addition, the following summary and detailed description are generally directed to a beverage container. However, as will be readily apparent to those skilled in the art, the present invention can be practiced with equal facility in packaging a wide variety of products such as soaps, chemicals, motor oils, powders, granules, foods, and the like.

In a particularly preferred embodiment of the present invention, a container's top end panel, bottom end panel, and body portion are of laminate construction comprised of an outer layer of stiff or rigid material, an intermediate layer of substantially gas-impermeable material, and an inner sealing layer of thermoplastic material. These layers may be secured either directly to one another, or indirectly to one another by means of one or more additional layers. The container's top and bottom end panels and body portion are preferably made by a high-speed manufacturing process wherein the three above-described layers of material are initially continuous webs that are subsequently laminated together, followed by cutting or stamping individual components from the resultant laminate web. Thereafter, the container's top and bottom end panels are placed on the respective edges of the container's body portion, followed by a sealing operation wherein the points of contact between the three components' inner layer of thermoplastic material are fused together to define a continuously sealed, product-contacting inner surface.

For the container's top end panel, it is of particular significance that, in one particularly preferred embodiment, a line of weakness defining a tear-out section is first cut in the web of rigid material before it is laminated to the intermediate and inner webs. Thereafter, easy-opening means such as a tape tab is non-critically attached to the outer surface of the tear-out section. "Non-critical" in this sense means that there need not be provided an air-tight or liquid-tight seal between the easy-open means and the tear-out section. "Non-critical" also means that the bond between the two can be achieved by using a common glue or hot melt adhesive, or by using a bonding method that directly fuses the materials together (e.g. induction, high frequency, ultrasonic), none of which require special characteristics such as gas-impermeability. The container is opened by pulling the opening means such that the tear-out section separates along the line of weakness from the outer stiff layer along with substantially coinciding portions of the intermediate layer and the inner layer that are attached thereto, thereby defining a dispensing aperture in the container's top end panel.

In another particularly preferred embodiment of the present invention, a discrete aperture is cut in the top end panel's outer web of rigid material before the intermediate and inner webs are laminated thereto. The discrete dispensing aperture exposes a coinciding portion of the intermediate web to which opening means such as a tape tab is attached, again involving a non-critical bond. The container is then assembled as described earlier. The container is opened by pulling the opening means which ruptures and tears the exposed coinciding portion of the intermediate layer along with a coinciding portion of the inner layer that is attached thereto, thereby defining a dispensing aperture in the container's top end panel.

In either of the above-described particularly preferred embodiments, an easy-open/reclosing means can be substituted for the opening means. An example of an easy-open/reclosing means is a rigid plug comprised of an easily-graspable upper flange having a lower cup formation depending therefrom. The lower cup formation, which is shaped complementary to the dispensing aperture ultimately created when the easy-open/reclosing means is removed from the container's top end panel, is again non-critically bonded to the tear-out section's upper surface or the exposed portion of the intermediate layer, whichever is the case. In the case of the line of weakness defining a tear-out section in the top end panel's outer stiff layer, the container is opened by pulling up on the plug's upper flange which tears the tear-out section from the outer stiff layer and ruptures and tears away substantially corresponding portions of the intermediate and inner layers that are attached thereto, thereby defining a dispensing aperture in the container's top end panel. The container can be reclosed by pressing the plug's lower cup formation back into the dispensing aperture.

In another particularly preferred embodiment of the present invention that is particularly well suited for a container having a peripheral rim around the container's top end panel, the container's dispensing aperture is nestled within either a depressed area in the top end panel or surrounded by an upwardly-projecting rib. When the container is tipped to dispense the product therein and returned to its upright position, any residual product trapped between the container's rim and the dispensing aperture is contained within either the depressed area or upwardly-projecting rib and channeled back into the container via the dispensing aperture rather than being allowed to spread out over the container's top end panel.

BRIEF DESCRIPTION OF THE DRAWINGS

While the specification concludes with claims that particularly point out and distinctly claim the present invention, it is believed that the present invention will be better understood by reading the following description with references made to the following drawings in which:

FIG. 1 is a perspective view of an easy-open container of the present invention.

FIG. 2 is an enlarged cross-sectional view of the container shown in FIG. 1 taken at a point corresponding to section line 2—2.

FIG. 3 is an enlarged cross-sectional view of the container shown in FIG. 1 taken at a point corresponding to section line 2—2, but shown with the container in its open position.

FIG. 10 is a cross-sectional view of a particularly preferred embodiment of the present invention that can be reclosed after the initial opening thereof.

FIG. 11 is a cross-sectional view of the container shown in FIG. 10, but shown showing the container's easy-open/reclosure device removed from the container's top end panel.

FIG. 12 is a cross-sectional view of the container shown in FIG. 10, but shown with the container's easy-open/reclosing device pressed back into the container's dispensing aperture.

FIG. 13 is a cross-sectional view of another particularly preferred embodiment of the present invention that can also be reclosed after the initial opening thereof.

FIG. 14 is a cross-sectional view of the container shown in FIG. 13, but shown with the container's easy-open/reclose element removed from the container's top end panel.

FIG. 15 is a cross-sectional view of the container shown in FIG. 13, but shown with the container's easy-open reclosure device pressed back into the container's dispensing aperture.

FIG. 16 is a perspective view of the top portion of a particularly preferred top end panel configuration.

FIG. 17 is an enlarged cross-sectional view of the top end panel shown in FIG. 16, taken along section line 17—17.

FIG. 18 is a perspective view of the top portion of a particularly preferred top end panel configuration.

FIG. 19 is an enlarged cross-sectional view of the top end panel shown in FIG. 18, taken along section line 19—19.

DETAILED DESCRIPTION OF THE INVENTION

Figure 4:
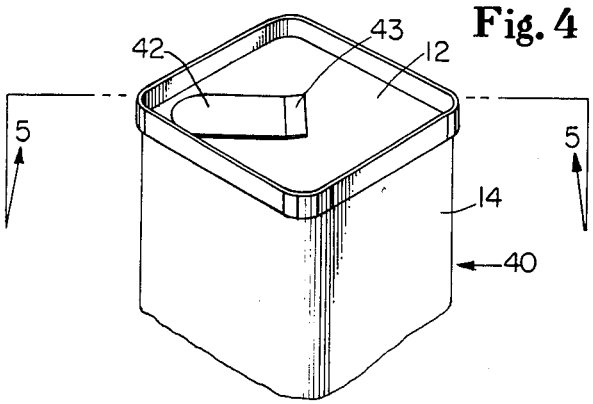
FIG. 4 is a perspective view of the top portion of an easy-open container that utilizes a tape tab.

FIG. 1 shows an easy-open container of the present invention generally indicated as 10 in its initial or unopened condition. In the exemplary embodiment shown, container 10 has a square cross-section with rounded corners. However, as with all other embodiments of the present invention later described and illustrated, container 10 may take on other cross-sectional configurations such as circular, oval, rectangular, or polygonal.

Container 10 generally comprises a top end panel 12, a body portion 14, and a bottom end panel 16, all of which are of laminated construction as can be seen in FIGS. 2 and 3. In FIG. 2, top end panel 12 comprises an outer layer of rigid or stiff material 18, an intermediate layer of substantially gas-impermeable material 20, and an inner sealing layer of thermoplastic material 22. Bottom end panel 16, which is not shown to avoid redundancy, is of the same laminate construction. Rigid layer 18 is preferably made of a material that is sufficiently stiff or rigid to provide strength, such as polyvinylchloride (PVC), polyester (PETP), polystyrene (PS), polypropylene (PP), methacrylate-butadiene-styrene copolymer (MBS) polycarbonate (PC), or paperboard. For intermediate layer 20, examples of materials that meet the definition of "substantially gas-impermeable" are aluminum or other metal foil, metalized substracts (e.g. metalized polypropylene, metalized polyester), or high gas barrier plastics such as ethylene vinyl alcohol (EVAL), polyvinylidenechloride (PVDC), copolymer of acrylonitrile (PAN), polyester (PET), or polyamide (PA). For thermoplastic inner sealing layer 22, which provides protection against flavor loss or contamination, suitable materials include polyethylene (PE), linear low density polyethylene (LLDPE), polypropylene (PP), or polyvinylchloride (PVC).

Top end panel 12 and bottom end panel 16 are preferably made in a high-speed production process wherein an outer web of stiff material, an intermediate web of substantially gas-impermeable material, and an inner web of thermoplastic material are secured together, for example, by a suitable glue or heat sealable thermoplastic, to form the laminate. It will of course be recognized that one or more additional layers could also be secured intermediate the aforementioned three layers without deviating from the scope of the present invention. In making top end panel 12, the web of outer stiff material is first provided with a push-in section 23 defined by a line of weakness 24 before the intermediate and inner webs are laminated to the outer web. Line 24 can either be a series of perforations or a continuous slit. In either case, line 24 is cut on three sides with the fourth side remaining intact or lightly scored to act as a hinge. Since the intermediate and inner webs are applied continuously to the outer web after line of weakness 24 has been formed, it is particularly significant that no special sealing operations are required around line 24 to keep the container's top end panel liquid tight and gas impermeable. Furthermore, since line 24 is cut in the outer web prior to bonding the intermediate and inner webs thereto, there is no danger of accidentally rupturing the intermediate and inner webs during the line 24 cutting step.

After the laminate web has been made, individual end panels 12 and 16 are stamped or cut from their appropriate laminated webs. Preferably, panels 12 and 16 are stamped with a die that cuts a series of small notches 26 along the panel's outer periphery, the purpose of which to be described later.

Body portion 14 is also of laminate construction and comprises an outer layer of stiff material 28, an intermediate layer of substantially gas-impermeable material 30, and an inner sealing layer of thermoplastic material 32. Body portion 14 is also preferably made in a high-speed process wherein the three layers are initially in web form and secured together by a suitable glue or heat sealable thermoplastic. Outer stiff layer 28 is preferably made of a polyethylene-coated fiber board. Intermediate layer 30 and inner layer 32 can be made of the same materials described for panels 12 and 16. After the three webs of material have been secured together, the resultant laminate is folded into a long tube having a longitudinal seam or butt joint. A laminated seal strip preferably comprised of polyethylene, PET, and polyethylene is then sealed to both the inside and outside surface of the butt joint before individual body portions are cut from the tube.

Alternatively, body portion 14 can be made by a high-speed co-extrusion process wherein materials such as PVC, ethylene vinyl alcohol (EVAL), and polyethylene (PE) are co-extruded into a long hollow tube followed by cutting individual body portions from the extruded tube.

In the final step in making individual containers containing product, top end panel 12 and bottom end panel 16 are placed on the ends of body portion 14. Before either the top or bottom end panel is applied and sealed to one end of the body portion, the open-ended container may be sterilized to provide an aseptic environment, followed by filling the container with product from its open end. Thereafter, the remaining end panel is applied to the open end and sealed.

The peripheral edges 13 and 17 on the end panels 12 and 16, respectively, are folded over the respective edges of body portion 14 such that notches 26 meet and appear to be closed or continuous as illustrated in FIG. 1. When panels 12 and 16 are properly attached to the ends of body portion 14, the joint or interface 34 between inner sealing layer 22 of top and bottom panels 12 and 16, and inner sealing layer 32 of body portion 14 are subjected to localized heating. When sufficiently heated, layers 22 and 32 melt together and, when cooled, bond together such that the filled container 10 now has a continuous, product-contacting inner layer of thermoplastic material. This inner layer not only makes the container liquid tight, but also provides excellent protection against flavor loss of the container's contents. In the case where intermediate layer 20 is a metallic foil, an ultrasonic sealing process can be used to heat and melt interface 34 between layers 22 and 32. Alternatively, the continuously sealed inner layer can be achieved by using an induction sealing process.

Referring now to FIG. 3, top end panel 12 of container 10 is opened by applying pressure to the outer surface of push-in section 23 which causes outer stiff layer 18 to break along line of weakness 24. Since intermediate layer 20 is secured to outer layer 18 and inner layer 22 is secured to intermediate layer 20, layers 20 and 22 rupture along a line that substantially corresponds to line of weakness 24, thereby defining a dispensing aperture in top end panel 12 generally indicated as 36. Once all three layers have ruptured, continuing pressure applied to outer layer 18 rotates push-in section 23 within the interior of container 10. Container 10 can now be tipped to dispense the contents therein.

Figure 5:
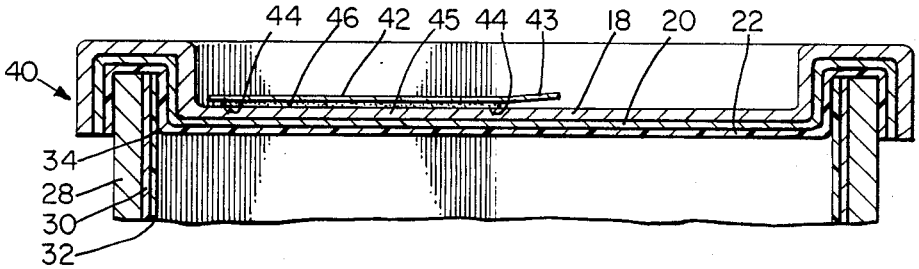
FIG. 5 is an enlarged cross-sectional view of the container shown in FIG. 4 taken at a point corresponding to section line 5—5.
Figure 6:
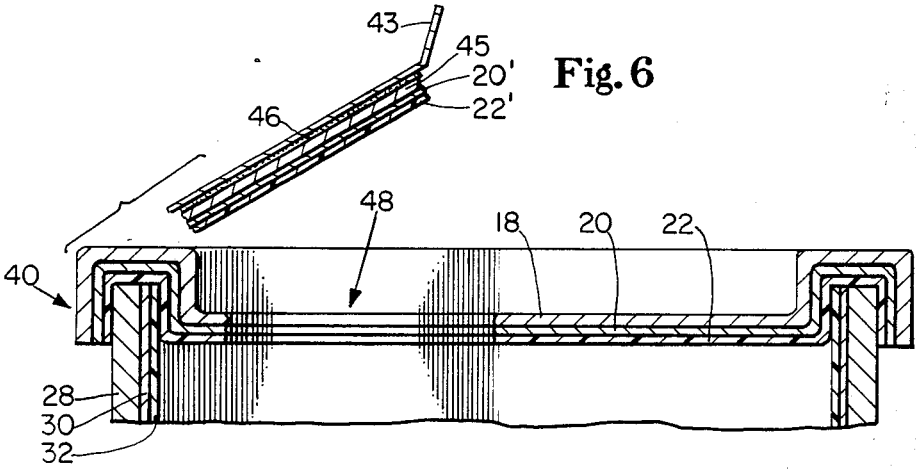
FIG. 6 is an enlarged cross-sectional view of the container shown in FIG. 4 taken at a point corresponding to section line 5—5, but shown with the tape tab being removed from the container's top lid.

Referring now to FIGS. 4–6, FIG. 4 shows the top portion of a preferred laminated container, generally indicated as 40, that uses a tape tab 42 having an easily-graspable section 43 as its easy-opening means. Container 40 is constructed in the same general manner described in conjunction with container 10 shown in FIGS. 1–3. As seen in FIG. 4, top end panel 12 and bottom end panel 16 (not shown) are comprised of an outer stiff layer 18, a substantially gas-impermeable intermediate layer 20, and a thermoplastic inner layer 22. Body portion 14 similarly has an outer stiff layer 28, a substantially gas-impermeable intermediate layer 30, and a thermoplastic inner layer 32. As with container 10, top end panel 12 and bottom end panel 16 are secured to body portion 14 such that the interface 34 between inner sealing layers 22 and 32 is sealed to form a continuous product-contacting inner surface.

In the laminate web process used to make top end panel 12, a line of weakness 44 is first made in the web of outer stiff material to define a removable section 45. Line of weakness 44 can either be continuous as illustrated or three-sided with a hinge as with the embodiment shown in FIGS. 1–3. After line of weakness 44 is made in the outer web, the intermediate web of substantially gas-impermeable material is secured to the outer web followed by securing the inner thermoplastic web to the intermediate web, which again eliminates the need to employ any special sealing operations around line of weakness 44 to keep the container liquid tight and gas impermeable. Either before or after discrete top end panels are stamped from the laminate web, tape tab 42 is secured to the outer surface of removable section 45 by a layer of glue or hot melt adhesive 46. Alternatively, if tape tab 42 is coated with a thin layer of thermoplastic material, tab 42 can be directly fused to the outer surface of removable section 45 by an appropriate method such as induction, high frequency, or ultrasonics. It is particularly significant that layer 46 need not possess any critical properties such as gas-impermeability. Furthermore, since layer 46 merely serves the function of securing tab 42 to removable section 45, a critical seal between tab 42 and outer layer 18 need not be provided as is normally the case in prior art structures.

Referring now to FIG. 6, container 40 is opened by pulling easily graspable section 43 of tape 42 up and away from lid 12 which causes removable section 45 to tear along line of weakness 44. In the process of pulling and removing tape 42 and attached section 45 from top end panel 12, substantially coinciding portions 20' and 22' rupture and separate from their respective layers, thereby defining a dispensing aperture 48 in top end panel 12. Container 40 can then be tipped to dispense the contents therein.

Figure 7:
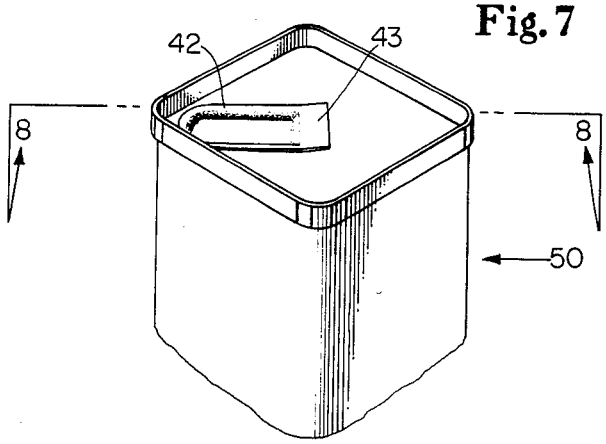
FIG. 7 is a perspective view of the top portion of another preferred easy-open container.
Figure 8:
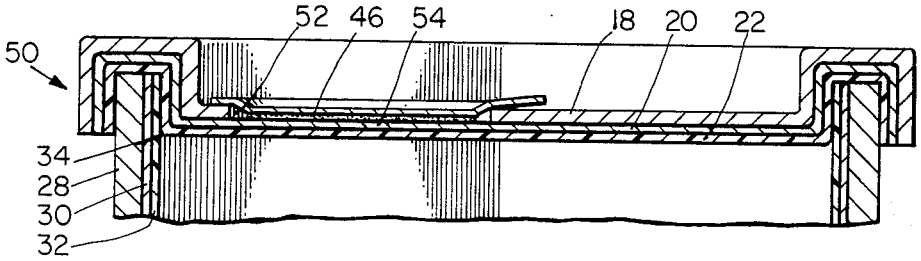
FIG. 8 is an enlarged cross-sectional view of the container shown in FIG. 7 taken at a point corresponding to section line 7—7.
Figure 9:
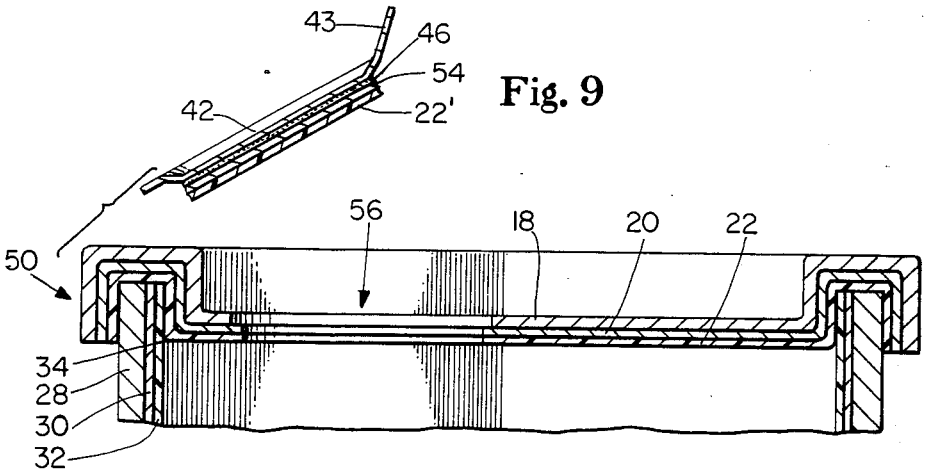
FIG. 9 is an enlarged cross-sectional view of the container shown in FIG. 7 taken at a point corresponding to section line 7—7, but shown with the container's tape tab being removed.

FIGS. 7–9 illustrate the top portion of another preferred laminated container generally indicated as 50. In the embodiment shown, an aperture 52 is first cut in the web of outer stiff material before the laminate web corresponding to layers 18, 20, and 22 is formed, thereby exposing a portion 54 of intermediate layer 20.

Either before or after discrete top end panels are stamped from the laminate web, tape tab 42 is secured directly to the exposed portion 54 of intermediate layer 20, again by using a non-critical layer of glue or hotmelt adhesive 46, or by using a bonding method that directly fuses the materials together (e.g. induction, high frequency, ultrasonic), all of which involve a non-critical bonding operation. As shown in FIG. 9, container 50 is opened by pulling easily-graspable section 43 of tab 42 such that exposed portion 54 of layer 20 and a substantially corresponding portion 22' of layer 22 rupture and separate from their respective layers, thereby creating and defining a dispensing aperture 56 in top end panel 12. Container 50 can then be tipped to dispense the contents therein.

FIGS. 10–12 illustrate the top portion of a particularly preferred easy-open top end panel that can also be reclosed. The laminated container 60, which is also constructed according to the earlier-described web laminating process, has a laminated end panel 12 that is similar to that shown in FIGS. 4–6. In this embodiment, however, a rigid plug 62 comprised of an easily-graspable upper flange 64 having a lower cup formation 66 depending therefrom is secured by a non-critical layer of glue or hotmelt adhesive 46 (or by a direct bonding method as previously described) to the outer surface of removable section 45 defined by a line of weakness 44 in outer stiff layer 12. Lower cup formation 66 is shaped complementary to the dispensing aperture that will be created when container 60 is opened as will be described later. If desired, plug 62 could be secured to the top of the container to prevent its becoming lost after opening, e.g., as by a hinge or strap (not shown). Since plug 62 is not initially responsible for sealing container 60, it can be made from common materials not having special properties such as gas impermeability. For example, plug 62 can simply be made from thermoformed or injection molded polyethylene or polystyrene.

As shown in FIG. 11, container 60 is initially opened by grasping and pulling up on the plug's upper flange 64 such that tear out section 45 separates from stiff layer 12 along line of weakness 44. In the process, substantially corresponding portions 20' and 22' rupture and separate from their respective layers 20 and 22, thereby defining a dispensing aperture 68 in top end panel 12. As shown in FIG. 12, container 60 may be reclosed after a portion of the container's contents have been dispensed by pressing lower cup formation 66 of plug 62 with attached layer portions 45, 20', and 22' back into dispensing aperture 68. Since lower cup formation 66 is shaped complementary to aperture 52, the interference or friction fit therebetween provides a liquid tight seal that prevents foreign matter from entering the container during storage and also allows container 60 to be shaken if desired.

Referring now to FIGS. 13–15, FIG. 13 illustrates the top portion of another particularly preferred laminate container generally indicated as 70. Container 70 is also an easy-open/reclosable container that uses a plug 62 as a means to initially open and subsequently reclose the container. As shown in FIG. 13, aperture 72 is first cut in the web of outer stift material before the laminate web comprised of layers 18, 20, and 22 is formed, thereby exposing a portion 54 of intermediate layer 20. Either before or after discrete top end panels are stamped from the laminate web, lower cup formation 66 of plug 62 is attached to exposed portion 54 of intermediate layer 20, again by a non-critical layer of glue or hotmelt adhesive 46, or by using a direct bonding method as earlier described, all of which involve a non-critical bonding operation. As shown in FIG. 14, container 70 is initially opened by grasping and pulling up on upper flange 64 such that exposed portion 54 of intermediate layer 20 and substantially corresponding portion 22' of inner layer 20 rupture and separate from their respective layers, thereby creating and defining a dispensing aperture 74 in top end panel 12. As shown in FIG. 15, container 70 may be reclosed after a portion of the container's contents have been dispensed by pressing lower cup formation 66 of plug 62 with attached layer portions 54' and 22' back into dispensing aperture 68. Again, since lower cup formation is shaped complementary to dispensing aperture 74 in top end panel 12, the interference fit therebetween provides a liquid tight seal that prevents foreign matter from entering the container during storage and also allows container 70 to be shaken if desired. As with the embodiment of FIGS. 10–12, plug 62 could be secured to the top of the container to prevent its becoming lost after opening, e.g., as by a hinge or strap (not shown).

FIGS. 16 and 18 with their respective cross-sectional views 17 and 19 show particularly preferred embodiments of two exemplary lid constructions that can be used in practicing any of the earlier described embodiments of the present invention. The added feature found in the top end panels illustrated in FIGS. 16 and 18 is particularly well suited for a container having an upstanding rim running about the periphery of the container's top end panel. In FIGS. 16 and 17, the die that is used to stamp top end panel 82 from the earlier-described laminated web forms a depressed area 84 that surrounds the pre-cut aperture (or line of weakness, whichever is the case) found in top end panel 82. Since the lid stamping takes place after the lamination process, depressed area 84 extends through all layers of the laminate, as can be seen in FIG. 17. When container 80 is tipped to dispense the product therein, any residual product trapped between rim 86 and dispensing aperture 88 is channeled back into the container via aperture 88 when the container is returned to its upright position rather than spreading out over the outer surface of the top panel 82.

In FIGS. 18 and 19, the die that is used to stamp top end panel 92 from the earlier-described laminated web forms an upwardly-projecting rib 94 that substantially surrounds the pre-cut aperture (or line of weakness, whichever is the case) found in top end panel 92. When container 90 is tipped to dispense the product therein, any residual product trapped between the container's upstanding rim 96 and dispensing aperture 98 is contained within the confines of rib 94 when container 90 is returned to its upright position rather than spreading out over the outer surface of top panel 92.

While several particularly preferred embodiments of the present invention have been described and illustrated, it will be apparent to those skilled in the art that various changes and modifications can be made without departing from the spirit and scope of the present invention. Accordingly, the following claims are intended to embrace such changes and modifications that are within the scope of the present invention.

What is claimed is:

1. A substantially gas-impermeable, easy-open container having a continuously sealed thermoplastic product-contacting inner surface prior to opening, said container comprising:

(a) a laminated body portion, a laminated bottom end panel, and a laminated top end panel all having a substantially rigid outer layer, a substantially gas-impermeable intermediate layer bonded to said outer layer, and a thermoplastic inner layer bonded to said intermediate layer, said body portion, said bottom end panel, and said top end panel being continuously sealed to one another by fusing of their said thermoplastic inner layers to one another at points of contact therebetween, thereby defining said continuously sealed thermoplastic product-contacting inner surface;

(b) a line of weakness and a hinge connecting the end points of said line of weakness to one another only in said substantially rigid outer layer of said laminated top end panel defining a hingedly-connected push-in section of predetermined size and shape, said push-in section having an upper surface and adapted to be separated from said laminated top end panel along said line of weakness and pushed into said container about said hinge along with a substantially coinciding portion of said intermediate layer bonded to said push-in section and a substantially coinciding portion of said thermoplastic inner layer bonded to said substantially coinciding intermediate layer when sufficient force is applied to said top surface of said push-in section, thereby creating a dispensing aperture in said laminated top end panel.

2. The easy-open container recited in claim 1 wherein said laminated top end panel has a depressed area, said depressed area substantially surrounding said push-in section in said substantially rigid outer layer of said laminated top end panel.

3. The easy open container recited in claim 1 wherein said laminated top end panel has an upwardly-projecting rib, said rib substantially surrounding said push-in section in said substantially rigid outer layer of said laminated top end panel.

4. A substantially gas-impermeable, easy-open container having a continuously sealed thermoplastic product-contacting inner surface prior to opening, said container comprising:

(a) a laminated body portion, a laminated bottom end panel, and a laminated top end panel all having a substantially rigid outer layer, a substantially gas-impermeable intermediate layer bonded to said outer layer, and a thermoplastic inner layer bonded to said intermediate layer, said body portion, said bottom end panel, and said top end panel being continuously sealed to one another by fusing of their said thermoplastic inner layers to one another at points of contact therebetween, thereby defining said continuously sealed thermoplastic product-contacting inner surface;

(b) a line of weakness and a hinge connecting the end points of said line of weakness to one another only in said substantially rigid outer layer of said laminated top end panel defining a hingedly-connected pull-up section of predetermined size and shape, said pull-up section having an upper surface; and (c) opening means having an easily-graspable section and a bottom surface, said bottom surface being secured to said upper surface of said pull-up section in said substantially rigid outer layer of said laminated top end panel, whereby pulling said opening means causes separation of said pull-up section from said laminated top end panel along said line of weakness and upward rotation about said hinge along with a substantially coinciding portion of said intermediate layer bonded to said pull-up section and a substantially coinciding portion of said thermoplastic inner layer bonded to said substantially coinciding intermediate layer, thereby creating a dispensing aperture in said laminate top end panel.

5. The easy-open container recited in claim 4 wherein said opening means comprises a tape tab.

6. The easy-open container recited in claim 4 wherein said laminated top end panel has a depressed area, said depressed area substantially surrounding said pull-up section in said substantially rigid outer layer of said laminated top end panel.

7. The easy-open container recited in claim 4 wherein said laminated top end panel has an upwardly-projecting rib, said rib substantially surrounding said pull-up section in said substantially rigid outer layer of said laminated top end panel.

8. A substantially gas impermeable, easy-open container having a continuously sealed thermoplastic product-contacting inner surface prior to opening, said container comprising;

(a) a laminated body portion, a laminated bottom end panel, and a laminated top end panel all having a substantially rigid outer layer, a substantially gas-impermeable intermediate layer bonded to said outer layer, and a thermoplastic inner layer bonded to said intermediate layer, said body portion, said bottom end panel, and said top end panel being continuously sealed to one another by fusing of their said thermoplastic inner layers to one another at points of contact therebetween, thereby defining said continuously sealed thermoplastic product-contacting inner surface;

(b) a line of weakness only in said substantially rigid outer layer of said laminated top end panel defining a removable section of predetermined size and shape, said removable section having an upper surface and being adapted to be torn away from said substantially rigid outer layer along said line of weakness to define an aperture therein; and (c) opening means having an easily-graspable section and a bottom surface, said bottom surface being secured to said upper surface of said removable section in said substantially rigid outer layer of said laminated top end panel, whereby removing said opening means from said laminated top end panel causes separation of said removable section from said laminated top end panel along said line of weakness as well as separation of a substantially coinciding portion of said intermediate layer bonded to said removable section and a substantially coinciding portion of said inner layer bonded to said substantially coinciding intermediate layer from their respective layers, thereby creating a dispensing aperture in said laminated top end panel, said dispensing aperture substantially corresponding in size and shape to said removable section in said substantially rigid outer layer of said laminated top end panel.

9. The easy-open container recited in claim 8 wherein said opening means comprises a tape tab.

10. The easy-open container recited in claim 8 wherein said laminated top end panel has a depressed area, said depressed area substantially surrounding said removable section in said substantially rigid outer layer of said laminated top end panel.

11. The easy-open container recited in claim 8 wherein said laminated top end panel has an upwardly-projecting rib, said rib substantially surrounding said removable section in said substantially rigid outer layer of said laminated top end panel.

12. A substantially gas-impermeable, easy-open container having a continuously sealed thermoplastic product-contacting inner surface prior to opening, said container comprising:

(a) a laminated body portion, a laminated bottom end panel, and a laminated top end panel all having a substantially rigid outer layer, a substantially gas-impermeable intermediate layer bonded to said outer layer, and a thermoplastic inner layer bonded to said intermediate layer, said body portion, said bottom end panel, and said top end panel being continuously sealed to one another by fusing of their said thermoplastic inner layers to one another at points of contact therebetween, thereby defining said continuously sealed thermoplastic product-contacting inner surface;

(b) a pre-cut aperture of predetermined size and shape only in said substantially rigid outer layer of said laminated top end panel, said pre-cut aperture exposing the coinciding portion of said intermediate layer of said laminated top end panel;

(c) opening means having an easily-graspable section and a bottom surface, said bottom surface being secured to said exposed coinciding portion of said intermediate layer of said laminated top end panel, whereby removing said opening means from said laminated top lid end panel causes separation of said exposed coinciding portion of said intermediate layer secured to said bottom surface of said opening means and a substantially coinciding portion of said inner layer bonded to said exposed coinciding portion of said intermediate layer from their respective layers, thereby creating a dispensing aperture in said laminated top end panel, said dispensing aperture substantially corresponding in size and shape to said pre-cut aperture in said substantially rigid outer layer of said laminated top end panel.

13. The easy-open container recited in claim 12 wherein said opening means comprises a tape tab.

14. The easy-open container recited in claim 12 wherein said laminated top end panel has a depressed area, said depressed area substantially surrounding said pre-cut aperture in said substantially rigid outer layer of said laminated top end panel.

15. The easy-open container recited in claim 12 wherein said laminated top end panel has an upwardly-projecting rib, said rib substantially surrounding said pre-cut aperture in said substantially rigid outer layer of said laminated top end panel.

16. A substantially gas-impermeable, easy-open/reclosable container having a continuously sealed thermoplastic product-contacting inner surface prior to opening, said container comprising:

(a) a laminated body portion, a laminated bottom end panel, and a laminated top end panel all having a substantially rigid outer layer, a substantially gas-impermeable intermediate layer bonded to said outer layer, and a thermoplastic inner layer bonded to said intermediate layer, said body portion, said bottom end panel, and said top end panel being continuously sealed to one another by fusing of their said thermoplastic inner layers to one another at points of contact therebetween, thereby defining said continuously sealed thermoplastic product-contacting inner surface;

(b) a line of weakness only in said substantially rigid outer layer of said laminated top end panel defining a removable section of predetermined size and shape, said removable section having an upper surface and being adapted to be torn away from said substantially rigid outer layer along said line of weakness to define an aperture therein; and (c) opening/reclosing means having an easily-graspable section and a bottom surface, said bottom surface being adhered to said upper surface of said removable section in said substantially rigid outer layer of said laminated top end panel, whereby removing said opening/reclosing means from said laminated top end panel causes separation of said removable section from said laminated top end panel along said line of weakness as well as separation of a substantially coinciding portion of said intermediate layer bonded to said removable section and a substantially coinciding portion of said inner layer bonded to said intermediate layer from their respective layers, thereby defining a dispensing aperture in said laminated top end panel, said dispensing aperture substantially corresponding in size and shape to said removable section in said substantially rigid outer layer of said laminated top end panel.

17. The easy-open/reclosable container recited in claim 16 wherein said opening/reclosing means comprises a plug, said plug having an upper flange area and a cup formation depending therefrom, said cup formation having said bottom surface and being shaped complementary to said removable section in said substantially rigid outer layer of said laminated top end panel.

18. The easy-open/reclosable container recited in claim 16 wherein said laminated top end panel has a depressed area, said depressed area substantially surrounding said removable section in said substantially rigid outer layer of said laminated top end panel.

19. The easy-open/reclosable container recited in claim 16 wherein said laminated top end panel has an upwardly-projecting rib, said rib substantially surrounding said removable section in said substantially rigid outer layer of said laminated top end panel.

20. A substantially gas-impermeable, easy-open/reclosable container having a continuously sealed thermoplastic product-contacting inner surface prior to opening, said container comprising:

(a) a laminated body portion, a laminated bottom end panel, and a laminated top end panel all having a substantially rigid outer layer, a substantially gas-impermeable intermediate layer bonded to said outer layer, and a thermoplastic inner layer bonded to said intermediate layer, said body portion, said bottom end panel, and said top end panel being continuously sealed to one another by fusing of their said thermoplastic inner layers to one another at points of contact therebetween, thereby defining said continuously sealed thermoplastic product-contacting inner surface;

(b) a pre-cut aperture of predetermined size and shape only in said substantially rigid outer layer of said laminated top end panel, said pre-cut aperture exposing the coinciding portion of said intermediate layer of said laminated top end panel;

(c) opening/reclosing means having an easily graspable section and a bottom surface, said bottom surface being secured to said exposed coinciding portion of said intermediate layer of said laminated top end panel, whereby removing said opening/reclosing means from said laminated top lid end panel causes separation of said exposed coincidental portion of said intermediate layer bonded to said bottom surface of said opening/reclosing means and a substantially coinciding portion of said inner layer bonded to said exposed coinciding portion of said intermediate layer from their respective layers, thereby creating a dispensing aperture in said laminated top end panel, said dispensing aperture substantially corresponding in size and shape to said pre-cut aperture in said substantially rigid outer layer of said laminated top end panel.

21. The easy-open/reclosable container recited in claim 20 wherein said opening/reclosing means comprises a plug, said plug having an upper flange area and a cup formation depending therefrom, said cup formation having said bottom surface and being shaped complementary to said pre-cut aperture in said substantially rigid outer layer of said laminated top end panel.

22. The easy-open/reclosable container recited in claim 21 wherein said depending cup formation of said plug has a small aperture therethrough, whereby a drinking straw may be inserted through said small aperture to pierce said substantially coincidental portion of said intermediate layer and said substantially coincidental portion of said inner layer.

23. The easy-open/reclosable container recited in claim 20 wherein said laminated top end panel has a depressed area, said depressed area substantially surrounding said pre-cut aperture in said substantially rigid outer layer of said laminated top end panel.

24. The easy-open/reclosable container recited in claim 20 wherein said laminated top end panel has an upwardly-projecting rib, said rib substantially surrounding said pre-cut aperture in said substantially rigid outer layer of said laminated top end panel.

25. A method of making a laminated web adapted for use in constructing a substantially gas-impermeable end panel for an easy-open container, said end panel having a continuous thermoplastic product-contacting inner surface prior to opening, said method comprising the steps of:

(a) forming a line of weakness and a hinge connecting the end points of said line of weakness to one another, thereby defining a hingedly-connected push-in section of predetermined size and shape at a predetermined location in a web of substantially rigid material, said web and said push-in section each having a bottom surface;

(b) adhering the top surface of a web of substantially gas-impermeable material to said bottom surface of said web of substantially rigid material as well as to said bottom surface of said push-in section, said web of substantially gas-impermeable material having a bottom surface; and (c) adhering the top surface of a web of thermoplastic material to said bottom surface of said web of substantially gas-impermeable material.

26. A method of making a laminated web adapted for use in constructing a substantially gas-impermeable end panel for an easy-open container, said end panel having a continuous thermoplastic product-contacting inner surface prior to opening, said end panel further including manually graspable means for opening said container, said method comprising the steps of:

(a) forming a line of weakness defining a removable section of predetermined size and shape at a predetermined location in a web of substantially rigid material, said web and said removable section each having a top and bottom surface;

(b) adhering the top surface of a web of substantially gas-impermeable material to said bottom surface of said web of substantially rigid material as well as to said bottom surface of said removable section, said web of substantially gas-impermeable material having a bottom surface;

(c) adhering the top surface of a web of thermoplastic material to said bottom surface of said web of substantially gas-impermeable material; and (d) securing the bottom surface of an opening means having an easily-graspable section to said top surface of said removable section in said web of substantially rigid material.

27. The method of making a laminated web as recited in claim 26 wherein said opening means comprises a tape tab.

28. A method of making a laminated web adapted for use in constructing a substantially gas-impermeable end panel for a container, said end panel having a continuous thermoplastic product-contacting inner surface prior to opening, said end panel further including manually graspable means for opening said container, said method comprising the steps of:

(a) cutting a discrete aperture in a web of substantially rigid material having a bottom surface;

(b) adhering the top surface of a web of substantially gas-impermeable material to said bottom surface of said web of substantially rigid material, whereby said aperture in said web of substantially rigid material exposes a coinciding portion of said web of substantially gas-impermeable material, said web of substantially gas-impermeable material having a bottom surface;

(c) adhering the top surface of a web of thermoplastic material to said bottom surface of said web of substantially gas-impermeable material; and (d) securing the bottom surface of an opening means having an easily-graspable section to said exposed coinciding portion of said web of substantially gas-impermeable material.

29. The method of making a laminated web as recited in claim 28 wherein said opening means comprises a tape tab.

30. A method of making a laminated web adapted for use in constructing a substantially gas-impermeable end panel for an easy-open/reclosable container, said end panel having a continuous thermoplastic product-contacting inner surface prior to opening, said end panel further including manually graspable means for opening and reclosing said container, said method comprising the steps of:

(a) forming a line of weakness defining a removable section of predetermined size and shape at a predetermined location in a web of substantially rigid material, said web and said removable section each having a top and bottom surface;

(b) adhering the top surface of a web of substantially gas-impermeable material to said bottom surface of said web of substantially rigid material, as well as to said bottom surface of said removable section, said web of substantially gas-impermeable material having a bottom surface;

(c) adhering the top surface of a web of thermoplastic material to said bottom surface of said web of substantially gas-impermeable material; and (d) securing the bottom surface of opening/reclosing means having an easily-graspable section to said top surface of said removable section in said web of substantially rigid material.

31. The method of making a laminated web as recited in claim 30 wherein said opening/reclosing means comprises a plug, said plug having an upper flange area and a cup formation depending therefrom, said cup formation having said bottom surface and being shaped complementary to said removable section in said web of substantially rigid material.

32. A method of making a laminated web adapted for use in constructing a substantially gas-impermeable end panel for an easy-open/reclosable container, said panel having a continuous thermoplastic product-contacting inner surface prior to opening, said end panel further including manually graspable means for opening and reclosing said container, said method comprising the steps of:

(a) cutting a discrete aperture in a web of substantially rigid material having a bottom surface;

(b) adhering the top surface of a web of substantially gas-impermeable material to said bottom surface of said web of substantially rigid material, whereby said aperture in said web of substantially rigid material exposes a coinciding portion of said web of substantially gas-impermeable material, said web of substantially gas-impermeable material having a bottom surface;

(c) adhering the top surface of a web of thermoplastic material to said bottom surface of said web of substantially gas-impermeable material; and (d) securing the bottom surface of an opening/reclosing means having an easily-graspable section to said exposed coinciding portion of said web of substantially gas-impermeable material.

33. The method of making a laminated web as recited in claim 32 wherein said opening/reclosing means comprises a plug, said plug having an upper flange area and a cup formation depending therefrom, said cup formation having said bottom surface and being shaped complementary to said aperture in said web of substantially rigid material.

34. A method of making a substantially gas-impermeable, easy-open container having a continuously sealed thermoplastic product-contacting inner surface prior to opening, said method comprising the steps of:

(a) forming a laminated top end panel having a substantially rigid outer layer, a substantially gas-impermeable intermediate layer bonded to said outer layer, and a thermoplastic inner layer bonded to said intermediate layer, said rigid outer layer having a discrete dispensing aperture therein, thereby exposing a coinciding portion of said gas-impermeable intermediate layer;

(b) adhering opening means to said exposed coinciding portion of said substantially gas-impermeable intermediate layer in said laminated top end panel;

(c) forming a laminated bottom end panel having a substantially rigid outer layer, a substantially gas-impermeable intermediate layer bonded to said outer layer, and a thermoplastic inner layer bonded to said intermediate layer;

(d) forming a laminated body portion having a substantially rigid outer layer, a substantially gas-impermeable intermediate layer bonded to said outer layer, and a thermoplastic inner layer bonded to said intermediate layer, said body portion having an upper edge and a lower edge; and (e) attaching said laminated top end panel to said upper edge of said body portion and attaching said laminated bottom end panel to said lower edge of said body portion whereby said thermoplastic inner layer of said laminated top end panel and said thermoplastic inner layer of said laminated bottom end panel are fused together with said inner thermoplastic layer of said laminated body portion at points of contact therebetween, thereby defining said continuously sealed thermoplastic product-contacting inner surface.

35. The method of making a substantially gas-impermeable, easy-open container as recited in claim 34 wherein said opening means comprises a tape tab.

36. A method of making a substantially gas-impermeable, easy-open/reclosable container having a continuously sealed thermoplastic product-contacting inner surface prior to opening, said method comprising the steps of:

(a) forming a laminated top end panel having a substantially rigid outer layer, a substantially gas-impermeable intermediate layer bonded to said outer layer, and a thermoplastic inner layer bonded to said intermediate layer, said rigid outer layer having a discrete dispensing aperture therein, thereby exposing a coinciding portion of said gas-impermeable intermediate layer;

(b) adhering the bottom surface of opening/reclosing means to said exposed coinciding portion of said substantially gas-impermeable intermediate layer in said laminated top end panel;

(c) forming a laminated bottom end panel having a substantially rigid outer layer, a substantially gas-impermeable intermediate layer bonded to said outer layer, and a thermoplastic inner layer bonded to said intermediate layer;

(d) forming a laminated body portion having a substantially rigid outer layer, a substantially gas-impermeable intermediate layer bonded to said outer layer, and a thermoplastic inner layer bonded to said intermediate layer, said body portion having an upper edge and a lower edge; and (e) attaching said laminated top end panel to said upper edge of said body portion and attaching said laminated bottom end panel to said lower edge of said body portion whereby said thermoplastic inner layer of said laminated top end panel and said thermoplastic inner layer of said laminated bottom end panel are fused together with said inner thermoplastic layer of said laminated body portion at points of contact therebetween, thereby defining said continuously sealed thermoplastic product-contacting inner surface.

37. The method of making a substantially gas-impermeable, easy-open container/reclosable container as recited in claim 36 wherein said opening/reclosing means comprises a plug, said plug having an upper flange area and a cup formation depending therefrom, said lower cup formation having said bottom surface and being shaped complementary to said aperture in said substantially rigid outer layer of said laminated top end panel.

* * * * *